US006401513B1

(12) United States Patent
Fritsch

(10) Patent No.: US 6,401,513 B1
(45) Date of Patent: Jun. 11, 2002

(54) PRESS BRAKE WITH CONTROL WEAR LINKAGES

(75) Inventor: Rudy Fritsch, Rosemere (CA)

(73) Assignee: R.F. Design Ltd., Montreal (CA)

( * ) Notice: Subject to any disclaimer, the term of this patent is extended or adjusted under 35 U.S.C. 154(b) by 0 days.

(21) Appl. No.: 09/671,273

(22) Filed: Sep. 28, 2000

(51) Int. Cl.[7] ..... B21J 9/18

(52) U.S. Cl. ..... 72/390.4; 72/390.5; 72/450; 100/272

(58) Field of Search ..... 72/390.4, 390.5, 72/389.3, 450; 100/283, 272

(56) References Cited

U.S. PATENT DOCUMENTS

| | | | | |
|---|---|---|---|---|
| 3,587,286 A | | 6/1971 | Fritsch | |
| 3,763,690 A | | 10/1973 | Kirincic et al. | |
| 4,070,896 A | * | 1/1978 | Heitner | 72/389.3 |
| 4,926,671 A | * | 5/1990 | Hill | 72/389.3 |

* cited by examiner

*Primary Examiner*—David Jones

(74) *Attorney, Agent, or Firm*—Ogilvy Renault; Guy J. Houle

(57) ABSTRACT

A press brake is comprised of a frame having a bed secured thereto with a ram displaceable to and away from the bed whereby to form metal sheets positioned on the bed. The ram is secured to a hydraulic piston through opposed symmetrical linkage assemblies. Each linkage assembly is connected adjacent opposed ends of the ram and includes a lever member pivotally secured to the frame by an anchor pin pivot connection. A link arm interconnects the lever member to the ram by pivot pin connections adjacent opposed ends of the link arm. An interconnecting bar interconnects the lever member of each linkage assembly together by a further pivot pin connection adjacent opposed ends of the interconnecting bar. The ram displacement piston has a piston rod end which is connected to the interconnecting bar by a pivot pin whereby to displace the interconnecting bar to cause the linkage assemblies to pivot in unison on their anchor pin pivot connection to cause the ram to be displaced in substantially perfect parallel relationship with the bed. The symmetrical linkage assemblies have identical pivot pin and anchor pin connections whereby wear of these connections during operation is substantially the same on opposed sides of the ram to ensure continuous parallel displacement of the ram.

5 Claims, 2 Drawing Sheets

PRESS BRAKE WITH CONTROL WEAR LINKAGES

TECHNICAL FIELD

The present invention relates to a press brake and more particularly to a press brake having control wear linkages whereby the press brake is continuously displaced in parallel relationship with the bed to ensure quality workmanship on metal pieces being formed by the press brake.

BACKGROUND ART

In my earlier U.S. Pat. No. 3,587,286, there is disclosed a press brake for cold forming of sheet metals. However, we have found that with such a machine design, maintenance is often required due to backlash on the connecting rod bushings which cause the rim to tilt due to the uneven amount of wear of the pivot connections of the linkages on both sides of the ram. We have discovered that the fact that the linkages on each side of the ram differ in number, the sum of bushing wear on one side differs from the sum of bushing wear on the other side. Accordingly, this causes the ram to tilt out of parallelism with the bed. To remedy this problem, it is necessary to change the pins and bushings frequently.

Leveling adjustments of press brakes has been a problem in the industry for many years. There have been several attempts to provide leveling mechanisms to remedy this problem and such are disclosed, for example, in U.S. Pat. No. 3,763,690 and 4,070,896. However, these leveling devices have proven costly and also require periodic maintenance and adjustments to ensure precise parallel movement between the ram and the bed.

SUMMARY OF INVENTION

It is a feature of the present invention to provide a press brake which substantially overcomes the above-mentioned disadvantages of the prior art in a simple, economical and effective manner.

Another feature of the present invention is to provide a press brake which provides substantially balanced wear of the pivot connections on opposed sides of the ram and wherein this is achieved by providing symmetrical linkage assemblies on opposed sides of the ram so that the wear on both sides of the ram is substantially the same and therefore the backlash in the connecting rod bushings is subtractive, that is the ram will tilt only in proportion to the difference in the actual backlash, rather than the sum.

Another feature of the present invention is to provide a press brake and wherein the ram is displaced substantially in perfect parallel relationship with the bed even if the pivot connections of the linkages are subjected to wear.

According to the above features, from a broad aspect, the present invention provides a press brake comprising a frame, a bed formed on the frame, and a ram displaceable to and away from the bed in a vertical plane. The ram has a lower metal working straight edge disposed parallel to the bed. The ram is displaceable by ram displacement means secured to the ram by opposed symmetrical linkage assemblies. Each of the linkage assemblies are connected adjacent opposed ends of the ram. Each of the linkage assemblies also include a lever member pivotally secured to the frame by an anchor pin pivot connection. A link arm interconnects the lever member to the ram by pivot pin connections adjacent opposed ends of the link arm. An interconnecting bar interconnects the lever member of each of the linkage assemblies together by a further pivot pin connection adjacent opposed ends of the interconnecting bar. The ram displacement means has a pivot pin connection with the interconnecting bar whereby to displace the interconnecting bar to cause the linkage assemblies to pivot in unison on their anchor pin pivot connection to cause the ram working straight edge to be displaced in substantially perfect parallel relationship with the bed. The symmetrical linkage assemblies have identical pivot pin and anchor pin connections whereby wear of the connections during operation is substantially the same on opposed sides of the ram whereby backlash in said pin connections is subtractive to minimize ram tilt and ensure substantially continuous parallel displacement thereof.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
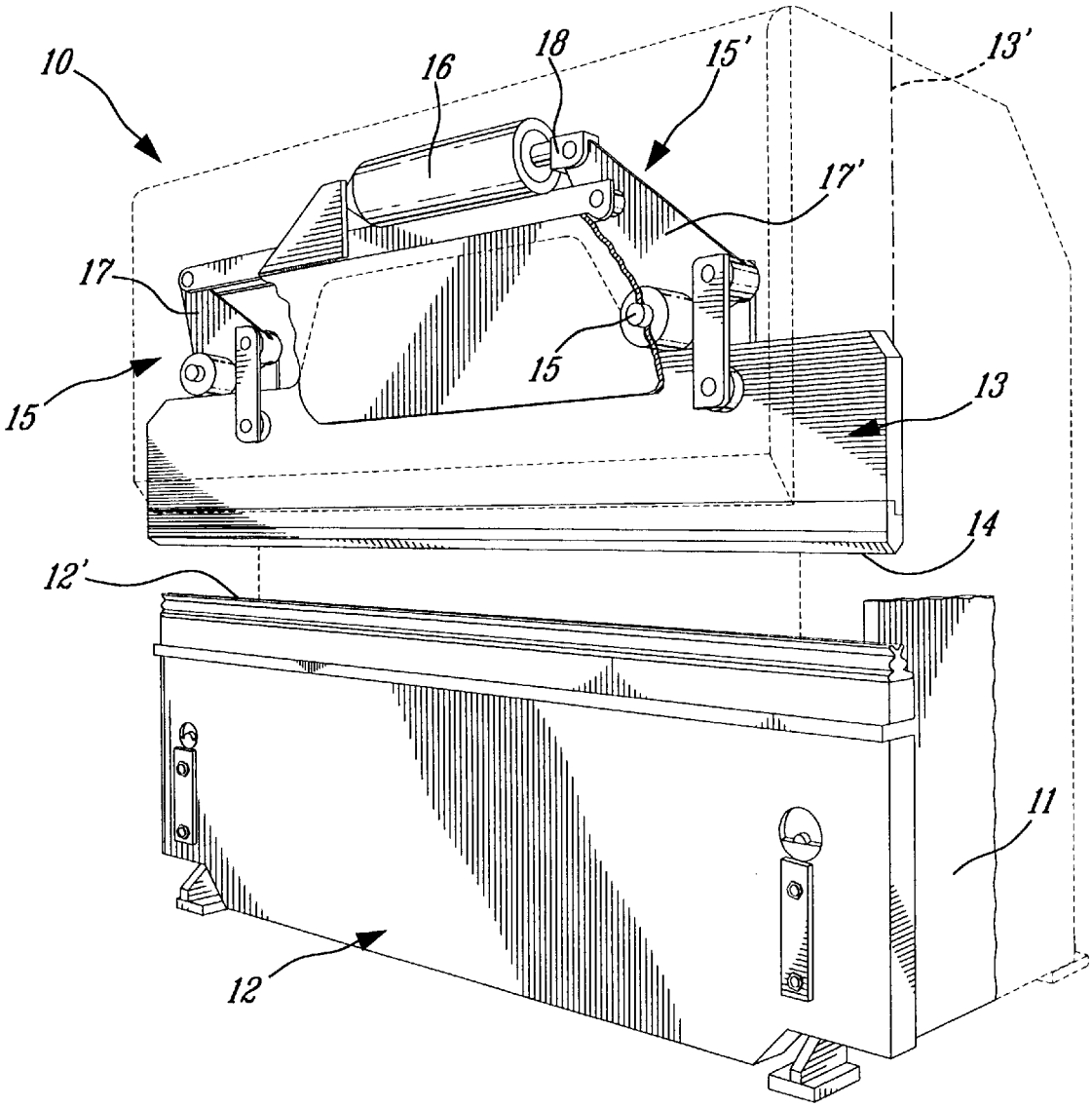
FIG. 1 ( PRIOR ART )
FIG. 1 is a perspective view, partly fragmented, of a press brake constructed in accordance with the prior art.

Referring to the prior art as illustrated in FIG. 1, a press brake is hereinshown, generally at 10, and comprises a frame 11, a fragmented portion thereof only being shown herein, and to which a bed 11 is secured. The bed 11 is usually constituted by a replaceable metal plate 12 securable in a vertical plane 13'. A ram 13 having a lower metal working straight edge 14 is also secured to the frame by a pair of linkage assemblies 15 secured adjacent opposed ends of the ram 13. Displacement means in the form of a hydraulic piston 16 is secured to a lever member 17 of one of the linkage assemblies 15 to cause the ram 13 to be displaced to and away from the support edge 12' of the bed 12.

As shown in FIG. 1, the link assembly 15' has a lever member 17' which is configured differently from the lever member 17 of the link assembly 15 and this is due to the fact that the piston rod end 18 of the piston 16 is pivotally secured to the top end of the lever member 17' by a pivot connection 19. Accordingly, as the piston rod reciprocates back and forth to actuate the ram 13, the pivot connections of the link assemblies on each side of the ram, 15 or their bushings, will wear. Because there are five pivot connections on the link assembly incorporating lever member 17' and only four on the other side, then the total wear of these bushings or pivot pin connections will be different on one side than on the other. If we assume that every pivot pin connection constitutes 0.005 inch of wear, there will be 0.020 inch of wear on the link assembly 15 side and 0.025 inch of wear on the link assembly 15' side where the piston rod end 18' is connected. Accordingly, this unevenness in total wear will cause the working straight edge 14 of the ram to slacken on one side more than the other and to tile when pressed against a workpiece and consequently resulting in imprecise metal bending.

Figure 2:
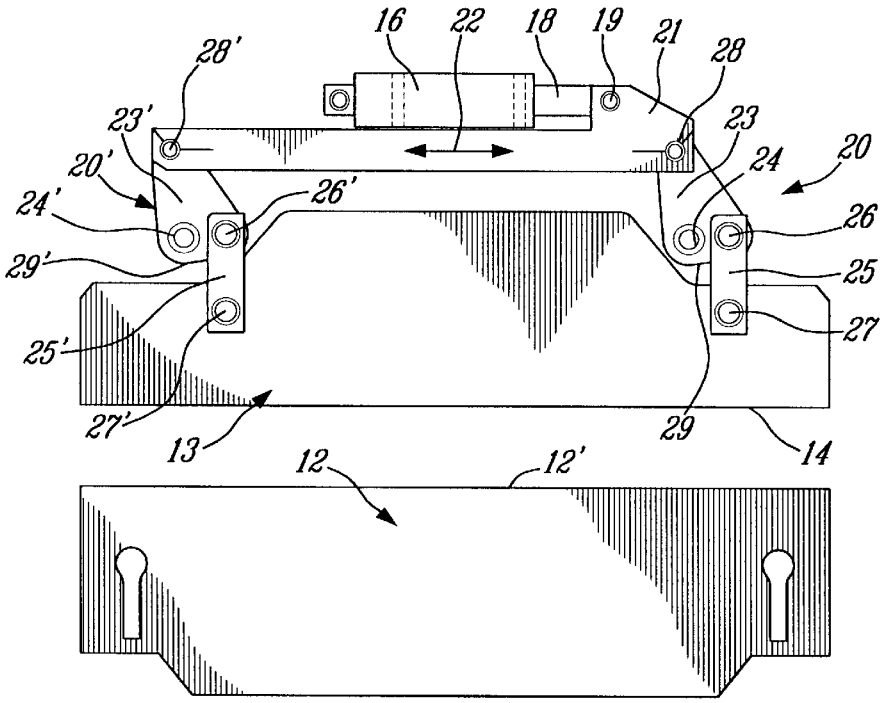
FIG. 2 is a plan view of the press brake of the present invention showing the ram and the bed and the interconnecting linkage of the ram.

With reference now to FIG. 2, there is shown the improved press brake construction of the present invention and wherein the ram 13 is provided with identical or symmetrical linkage assemblies 20 and 20' on opposed sides thereof to interconnect with the interconnecting bar 21 to which the hydraulic piston 16 is secured. The piston rod 18 is not secured directly to the linkage 20. The piston 16, by actuating its piston rod 18 which is secured on pivot connection 19 provided on the interconnecting bar 21, causes the bar 21 to reciprocate in the directions of arrow 22. The bar 21 engages the linkage assemblies 20 and 20' through both ends of the bar 21, to cause the linkages to move to the ram 13 up and down in perfect parallel relationship with the straight support edge 12' of the bed 12. This is achieved by having, as pointed out above, symmetrical linkage assemblies 20 and 20' connected at opposed ends of the ram.

Each of the linkage assemblies include a lever member 23 and 23' which is pivotally secured to the frame by an anchor pin pivot connection 24 and 24'. A link arm 25 and 25' interconnects the lever member 23 and 23', respectively, to the ram 13 by pivot pin connections 26 and 27 and 26' and 27', respectively, and disposed adjacent opposed ends of the link arm 25 and 25'. The interconnecting bar 21 is secured at a top end of the lever members 23 and 23' by further pivot connections 28 and 28', respectively. Accordingly, it can be seen that each of the linkage assemblies 20 and 20' have one anchor pin pivot connection 24 and 24' and three pivot pin connections 26–26', 27–27' and 28–28'. Accordingly, there are even numbers of pivot pin connections on opposed sides of the ram whereby wear of these connections during operation of the ram is substantially balanced on opposed sides of the ram wherein any backlash in the bushings is subtractive to ensure substantially continuous parallel displacement of the ram.

As can be seen, the lever members 23 and 23' are constituted by flat metal plates of substantially triangular outline, but this shape can vary to achieve the same results. The anchor pin pivot connection 24 and 24' and the top pivot connection 26 and 26' of the link arm 25 and 25' are disposed in fixed spaced relationship adjacent a lower edge 29 and 29' of the lever member 23 and 23', while the interconnecting bar pivot connections 28 and 28' are disposed above the lower edge at a predetermined position in the apex portion of the lever members.

Figure 3:
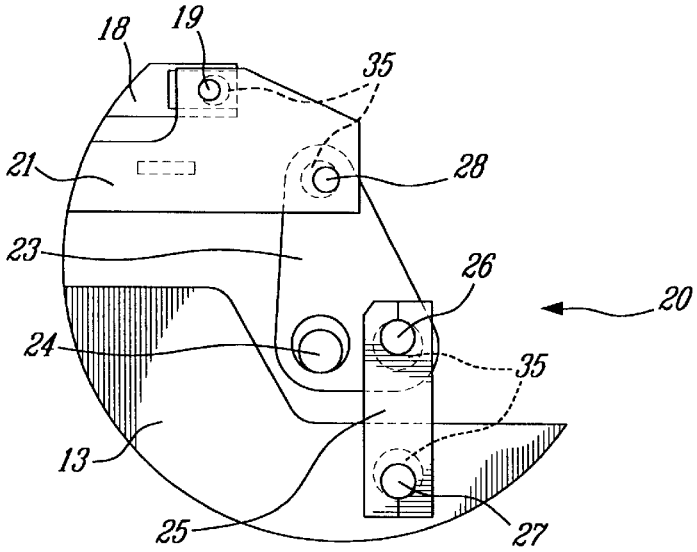
FIG. 3 is an enlarged fragmented view showing the linkage assembly interconnected to one end of the interconnecting bar.
Figure 4:
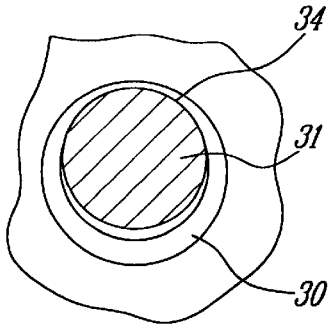
FIG. 4 is an enlarged view showing bushing wear in the pivotal pin connections.

FIGS. 3 and 4 illustrate how the wear takes place in these linkage assemblies and this wear is somewhat exaggerated to illustrate the areas 35 of diametrical slackness (clearance) under the cylinder force. As shown in FIG. 4, bushings 30 are usually secured about these connecting pins 31 and these bushings can withstand a certain amount of wear as illustrated at 32 before being replaced. Depending on the direction of forces applied to the pivot pins, the wear will be located in a certain area of the bushing but because the linkage assemblies 20 and 20' are symmetrical, this wear will be substantially balanced or the same on each side of the ram, as previously described and accordingly, replacement of these bushings is much less frequent than if the total bushing wear on one side was greater than on the other, as is the case with the prior art referred to hereinabove where there are more bushings on one side than the other, which allows the ram to tilt as a sum of the backlashes caused by bushing wear. Accordingly, with the present invention there is provided a press brake with control wear linkages achieved by simple design and permitting less frequent maintenance and at the same time providing an economical solution to the problem in question.

It is pointed out that it is within the ambit of the present invention to cover any obvious modifications of the preferred embodiment described herein, provided such modifications fall within the scope of the appended claims.

I claim:

1. A press brake comprising a frame, a bed formed on said frame, a ram displaceable to and away from said bed in a vertical plane, said ram having a lower metal working straight edge disposed in facial relationship and parallel to said bed, said ram being displaceable by a single hydraulic piston secured to and above said ram by opposed symmetrical linkage assemblies, each said linkage assemblies being connected adjacent opposed ends of said ram, each said linkage assemblies including a lever member pivotally secured to said frame by an anchor pin pivot connection (24), a link arm (25) interconnecting said lever member to said ram by pivot pin connections (26–27) adjacent opposed ends of said link arm, a single interconnecting straight bar (21) interconnecting said lever member of each said linkage assemblies together by a further pivot pin connection (28) adjacent opposed ends of said interconnecting bar, said hydraulic piston having a pivot pin connection (19) with said interconnecting bar whereby to axially displace said interconnecting bar in parallel relationship to said lower metal working straight edge to cause said linkage assemblies to pivot in unison on their said anchor pin pivot connection to cause said ram working straight edge to be displaced in substantially perfect parallel relationship with said bed, said symmetrical linkage assemblies having identical pivot pin and anchor pin connections whereby wear of said connections during operation is substantially the same on opposed sides of said ram whereby backlash in said pin connections is subtractive to minimize ram tilt and ensure substantially continuous parallel displacement thereof.

2. A press brake as claimed in claim 1 wherein said hydraulic piston has a cylinder anchored to said frame and a piston rod end secured to said interconnecting bar.

3. A press brake as claimed in claim 1 wherein said anchor pin pivot connection and one of said pivot pin connections at an opposed end of said link arm are disposed in fixed spaced relationship adjacent a lower edge of said lever member, said further pivot pin connection of said interconnecting bar being disposed spaced above said lower edge at a predetermined position.

4. A press brake as claimed in claim 3 wherein said lever member is a flat metal plate of substantially triangular outline, said interconnecting bar being pivotally secured adjacent an apex portion of said lever members.

5. A press brake as claimed in claim 1 wherein said pivot pin connections and anchor pivot pin connections of said symmetrical linkage assemblies have bushings, said wear of said connections being located in said bushings.

* * * * *